US008539726B2

(12) United States Patent
Laiho et al.

(10) Patent No.: US 8,539,726 B2
(45) Date of Patent: Sep. 24, 2013

(54) EXPANSION JOINT SYSTEM OF CONCRETE SLAB ARRANGEMENT

(75) Inventors: Topi Laiho, Lahti (FI); Trent W. Davis, Roborough (GB)

(73) Assignee: Peikko Group Oy, Lahti (FI)

( * ) Notice: Subject to any disclaimer, the term of this patent is extended or adjusted under 35 U.S.C. 154(b) by 203 days.

(21) Appl. No.: 12/812,295

(22) PCT Filed: Jan. 20, 2009

(86) PCT No.: PCT/FI2009/050048

§ 371 (c)(1),
(2), (4) Date: Aug. 20, 2010

(87) PCT Pub. No.: WO2009/092855

PCT Pub. Date: Jul. 30, 2009

(65) Prior Publication Data

US 2010/0325996 A1 Dec. 30, 2010

(30) Foreign Application Priority Data

Jan. 21, 2008 (FI) ..... 20085046

(51) Int. Cl.
*E04B 1/48* (2006.01)
*E04B 1/68* (2006.01)

(52) U.S. Cl.
USPC ..... 52/334; 52/340; 52/341; 52/396.05; 52/322; 404/66; 404/59

(58) Field of Classification Search
USPC ..... 52/223.7, 223.9, 223.11, 340, 396.05, 52/333, 334, 338, 341, 319, 322, 396.04; 404/51, 47, 52, 59, 66, 60, 88, 87
See application file for complete search history.

(56) References Cited

U.S. PATENT DOCUMENTS 2,108,393 A * 2/1938 Schulz ..... 404/52
2,260,657 A * 10/1941 Bohnsack ..... 52/223.7
2,265,301 A * 12/1941 Meyer et al. ..... 404/47
2,355,771 A * 8/1944 Yeoman ..... 404/53
2,698,560 A * 1/1955 Heltzel et al. ..... 404/2

(Continued)

FOREIGN PATENT DOCUMENTS

DE 10 2004 006 618 A1 9/2004
EP 0 773 324 A1 5/1997

(Continued)

OTHER PUBLICATIONS

Abstract of Finnish Utility Patent No. 6036, published Nov. 28, 2003.

(Continued)

*Primary Examiner* — Phi A
(74) *Attorney, Agent, or Firm* — Oliff & Berridge, PLC

(57) ABSTRACT

An expansion joint system of a concrete slab arrangement, comprising an expansion joint reinforcement to be arranged between a first and a second concrete slab, the expansion joint reinforcement comprising at least one lo-cal or continuous dowel which is arranged to transfer loads perpendicular to the slab plane. The expansion joint reinforcement comprises an additional reinforcement comprising at least one clenching pin and to be arranged in the vicinity of the dowel in concrete, the additional reinforcement being arranged to adhere to the concrete above and below the dowel by means of a widening forming the clench point.

13 Claims, 2 Drawing Sheets

(56) References Cited

U.S. PATENT DOCUMENTS

| | | | | |
|---|---|---|---|---|
| 3,180,057 | A * | 4/1965 | Pritzker | 52/246 |
| 3,401,497 | A * | 9/1968 | Gregory, Jr. et al. | 52/677 |
| 4,080,765 | A * | 3/1978 | Fasano | 52/223.7 |
| 4,196,558 | A * | 4/1980 | Jungbluth | 52/649.2 |
| 4,571,913 | A * | 2/1986 | Schleich et al. | 52/649.2 |
| 4,616,464 | A * | 10/1986 | Schleich et al. | 52/834 |
| 5,826,391 | A * | 10/1998 | Underwood | 52/414 |
| 6,237,297 | B1 * | 5/2001 | Paroly | 52/652.1 |
| 6,308,478 | B1 * | 10/2001 | Kintscher et al. | 52/223.7 |
| 6,955,015 | B2 * | 10/2005 | Manthei | 52/223.7 |
| 2010/0140837 | A1 * | 6/2010 | Biebaut et al. | 264/267 |

FOREIGN PATENT DOCUMENTS

| | | |
|---|---|---|
| EP | 1 389 648 A1 | 2/2004 |
| FI | 982675 | 4/2000 |
| FI | 20010213 | 8/2002 |
| GB | 2 075 080 A | 11/1981 |
| WO | WO 00/23653 | 4/2000 |
| WO | WO 02/063115 A1 | 8/2002 |

OTHER PUBLICATIONS

Abstract of Finnish Utility Patent No. 6124, published Feb. 16, 2004.

Abstract of Finnish Utility Patent No. 6759, published Jul. 29, 2005.

International Search Report issued in corresponding International Application No. PCT/FI2009/050048, mailed May 18, 2009.

International Preliminary Report on Patentability issued in corresponding International Application No. PCT/FI2009/050048, completed May 18, 2010.

Search Report issued in corresponding Finnish Application No. 20085046, dated Oct. 28, 2008. (with English-language translation).

* cited by examiner

EXPANSION JOINT SYSTEM OF CONCRETE SLAB ARRANGEMENT

The invention relates to an expansion joint system of a concrete slab arrangement, comprising an expansion joint reinforcement to be arranged between a first and a second concrete slab, the expansion joint reinforcement comprising at least one local or continuous dowel which is arranged to transfer loads perpendicular to the slab plane.

Expansion joint reinforcements are mainly used in connection with ground slab arrangements. Ground slab arrangements are structures formed of concrete slabs and cast directly in place for example upon a sand bed on the construction site.

It is preferable to make the slabs used in ground slab arrangements as thin as possible, whereby the consumption of concrete remains as small as possible.

The slabs of ground slab arrangements are supported against the ground. Although the ground under the slab is made as compact as possible, its load-carrying capacity is not uniform. Therefore, even a thin ground slab must be capable of dividing point load, for example, over a wider area so that no local dents are generated in the slab. Due to this, a ground slab is usually provided with a steel wire net to be installed halfway of its thickness. The wire net also evens out the stresses caused by the shrinking of the slab.

Usually it is necessary to cover relatively large areas by means of ground slab arrangements. Due to the shrinkage and thermal movements of concrete, large areas must be divided into smaller parts with expansion joints. An expansion joint must allow adjacent slabs of the arrangement to move horizontally relative to each other due to shrinkage and thermal movements. These movements mean here movements that are in the direction of the joint and perpendicular to the joint. In contrast, vertical movements perpendicular to the slab plane must be prevented, in other words the joint must be capable of transferring vertical load between the slabs of a slab arrangement.

The joint points are the weakest parts in slab arrangements because a slab is not capable of dividing a load at the edge over a wide area in the ground. In other words, local dents may be generated. Another significant aspect is splitting of the slab edge, for example under a wheel load.

The structures in the joint must also stay in place, i.e. stay adhered to the concrete even if the surrounding concrete wore down or split. This shows particularly when wheel loads are directed at the joint.

Before the expansion joint reinforcements presently on the market, it was, for example, sawing of a large cast slab into smaller parts after casting that was used. However, sawing was slow and expensive, and the edges of the joint would also break up.

A second example of the above-mentioned old techniques is the use of angle irons to be pressed into the cast after sawing. Disadvantages of this technique were its slowness, high costs, and also determination of the right timing so that the concrete would not harden too much, in other words it was difficult to know whether the angle iron would still adhere to the concrete and stay there in load situations.

A third example is the use of through tenons, i.e. bars to be installed at the edge of a concrete cast. The intention was to reduce adhesion at one end of the bars, for example by means of bituminization. However, a disadvantage was the slow installation in the mould because it was necessary to make holes in the mould. There was also the problem of high costs and, in addition, practical difficulties in installing, for instance due to the fact that the bars had to be exactly parallel so as not to prevent the shrinking movements of the slab.

To eliminate problems of the above solutions, a wide variety of expansion joint reinforcement solutions differing from each other have been provided in the field. The above expansion joint reinforcement solutions known in the field are represented by, for example, the solutions disclosed in FI patent publications 110631 and 116154 as well as FI utility models 6759, 6124 and 6036.

The expansion joint reinforcement solutions described above transfer from one slab to another forces in the direction perpendicular to the surface of the slab. The solutions also allow horizontal movements between the slabs. The load transfer capacity of the expansion joints has been implemented by providing a dowel in the mid-area of the slab height either by means of a steel plate or by shaping a concrete dowel. The dowel may be formed of at least one local plate dowel, such as in the solution of FI patent publication 110631, or of a continuous dowel made of concrete, such as in the solution of FI patent publication 116154.

The dowel divides, in the direction of height, the concrete slab into different parts which function separately and do not support each other in load situations. It is to be noted that although it looks thin, a steel dowel has, nevertheless, higher load transfer capacity than the concrete parts divided by the dowel. The weakest point, i.e. the determining factor in the load transfer capacity, is the concrete part either in the dowel or above or below the dowel.

As regards FI utility model 6036, it can be mentioned that in this solution there is not only a continuous dowel but also a pin arrangement in the horizontal direction. This does not prevent the concrete from breaking up above or below the dowel. A vertical pin arrangement is intended for fitting the joint in place and it does not prevent the concrete from breaking up above or below the dowel either.

The capacity of the above known solutions can be increased by means of additional reinforcement. The usual additional reinforcement has been loop reinforcement formed of U-shaped ribbed bars. The loop is installed in such a way that one branch of U is close to the lower surface of the slab. The end rises upright and the other branch is close to the upper surface of the slab. The use of additional reinforcement of this type usually requires the use of a thicker slab, which, in turn, greatly increases the costs because concrete is expensive. Loop reinforcement cannot be made very low, i.e. in such a way that the upright part is short, without loosing steel strength because concrete reinforcing irons have rather large bending radii. Usually such additional reinforcement can be used in thick slabs having two reinforcement meshes, one close to the lower surface of the slab and one close to the upper surface. The branches of the U loop are then level with the meshes. Installing such additional reinforcement is slow because the branches must be fitted into the reinforcement meshes, which increases the costs.

An object of the invention is to provide an expansion joint system of a concrete slab arrangement, by means of which disadvantages of the prior art can be eliminated. This is achieved with an expansion joint system of a concrete slab arrangement according to the invention. The expansion joint system of a concrete slab arrangement according to the invention is characterized in that the expansion joint reinforcement comprises an additional reinforcement comprising at least one clenching pin and to be arranged in the vicinity of the dowel in concrete, the additional reinforcement being arranged to adhere to the concrete above and below the dowel by means of a widening forming the clench point.

An advantage of the concrete slab arrangement according to the invention is that the invention allows the shear capacity of the concrete parts above and below the expansion joint dowel to be increased in a simple manner. The weakest point, i.e. the determining factor, in the load transfer capacity is specifically the concrete part either in the dowel or above or below it, as described earlier. An advantage of the invention is specifically the fact that the shear capacity of the concrete parts above and below the expansion joint dowel can be increased on the construction site with a simple, easily installable additional reinforcement. It is quick and easy to install this reinforcement to intermesh with the reinforcement mesh.

The invention will now be described in greater detail with reference to the embodiment examples shown in the drawing, whereby FIG. 1 shows a principled view of a first embodiment of an expansion joint system of a concrete slab arrangement according to the invention in the direction of the joint between two concrete slabs;

Figure 1:
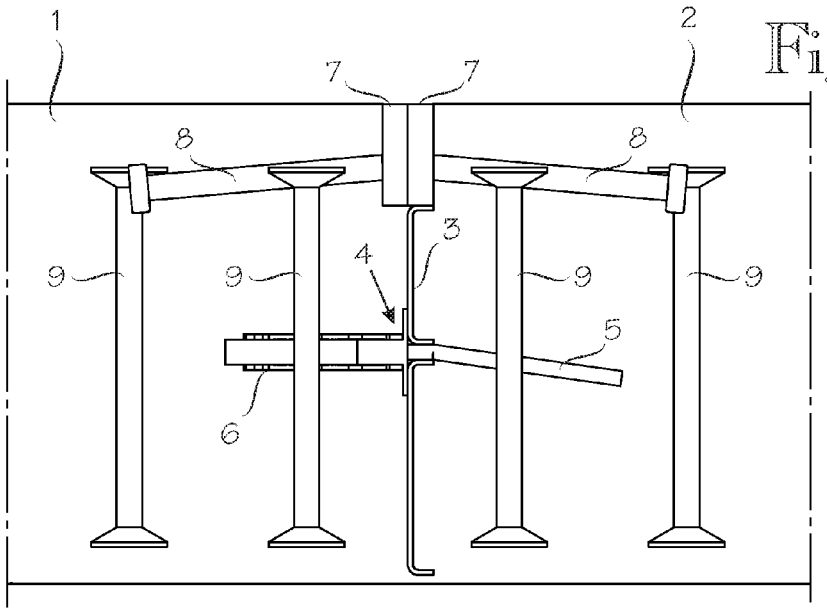
Figure 2:
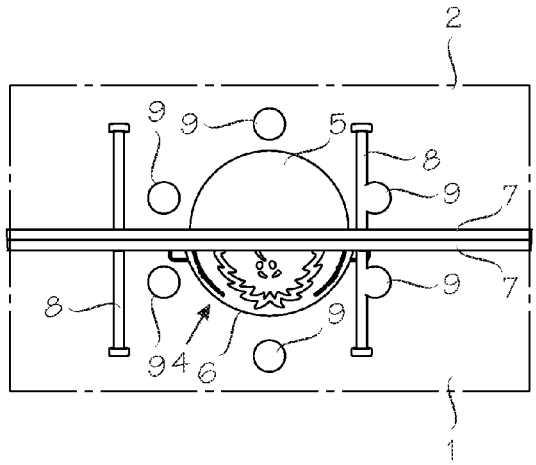
FIG. 2 shows a principled top view of the embodiment of FIG. 1.
Figure 3:
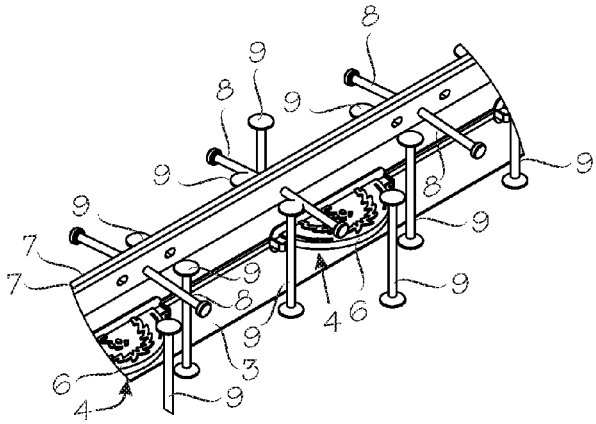
FIG. 3 shows a principled perspective view of an expansion joint reinforcement of the embodiment according to FIGS. 1 and 2.

FIGS. 1 to 3 show a first embodiment of an expansion joint system of a concrete slab arrangement according to the invention. FIGS. 1 and 2 show the first embodiment of the expansion joint system of a concrete slab arrangement according to the invention as being installed in connection with two concrete slabs. FIG. 3, in turn, shows a perspective view of only the reinforcement parts of the embodiment according to FIGS. 1 and 2.

In FIGS. 1 to 3, reference numerals 1 and 2 denote concrete slabs, and reference numeral 3 denotes a plate part having a dowel 4 attached to it. The dowel 4 is formed of a dowel plate 5 and a casing part 6.

In the embodiment of FIGS. 1 to 3, reference numeral 7 further denotes a reinforcement arranged at the upper edge of the slab and also comprising a horizontal reinforcement part 8.

The dowel plate 5 of the dowel 4 is attached to the first concrete slab 1 in such a way that its one edge protrudes from the edge of the concrete slab 1. The part protruding from the edge of the concrete slab 1 and extending to the other side of the joint to the concrete slab 2 is prevented from adhering to the concrete slab 2 by means of the casing part 6. The casing part 6 can be manufactured of plastic material, for example. On the side of the concrete slab 1, the dowel plate 5 adheres to the concrete. When the concrete slabs 1, 2 are shrinking, the dowel plate moves inside the casing part 6 and allows subsequently the movements of the slab also in the longitudinal direction of the joint. The dowel has been arranged in place at the joint by, for example, fitting a structure according to FIG. 3 in place in the mould before casting. The plate part 3 and the reinforcement 7 thus function as the edge of the mould, whereby after the casting a joint is provided between the slabs 1, 2, as shown in FIGS. 1 and 2.

However, the dowels do not have to be fixed to the expansion joint reinforcement but they may also be individually installed on the construction site, in other words the invention may also be applied in such a way that at first, only one slab is cast on the construction site and moulded with plywood, to which the casing parts are attached. After the cast has been hardened, the plywood is taken off, the casing parts being thus fixed to the cast, whereby dowels can be installed in them. After this, another slab can be cast and so on.

The above dowel structure allows the slabs to move in the horizontal direction of the slabs, as described earlier.

The above dowel structure and its functioning in an expansion joint belong to conventional technology known by a person skilled in the art, so these aspects are not described in greater detail in this context. In this context, reference is made to FI patent publication 110631, for example.

In accordance with an essential idea of the invention, the expansion joint reinforcement comprises an additional reinforcement comprising at least one clenching pin 9 and to be arranged in the vicinity of the dowel 4 in concrete. The additional reinforcement comprising at least one clenching pin is arranged to adhere to the concrete above and below the dowel 4 by means of a widening forming the clench point. The additional reinforcement may comprise one or more clenching pins 9.

The clenching pin 9 or clenching pins 9 forming the additional reinforcement is/are in a substantially vertical position relative to the upper and lower surfaces of the concrete slabs 1, 2, as shown in FIG. 1, for example.

The positioning of the clenching pins 9 is not in any way restricted to the examples of FIGS. 1 to 3 but the position and the number of clenching pins may naturally vary according to the need. What is essential is that the clenching pins 9 are in the vicinity of the dowels, extend above and below the dowel and adhere to the concrete above and below the dowel 4 by means of clench points. The shape of the widenings, i.e. clench points, at both ends of the clenching pin 9 may naturally differ from the one shown in FIGS. 1 to 3; in other words, the shapes of the clench points may vary completely freely according to the need.

The clenching pins 9 may preferably be manufactured of steel parts. Ribbed bars represent an example of suitable optional steel parts.

Figure 4:
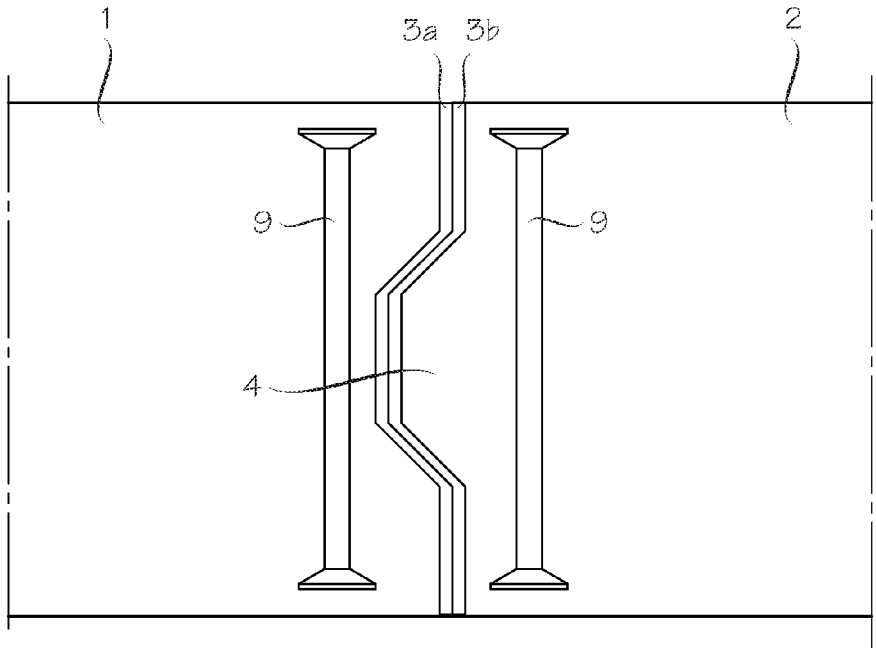
FIG. 4 shows a principled view of a second embodiment of the expansion joint system according to the invention in the direction of the joint between two concrete slabs.
Figure 5:
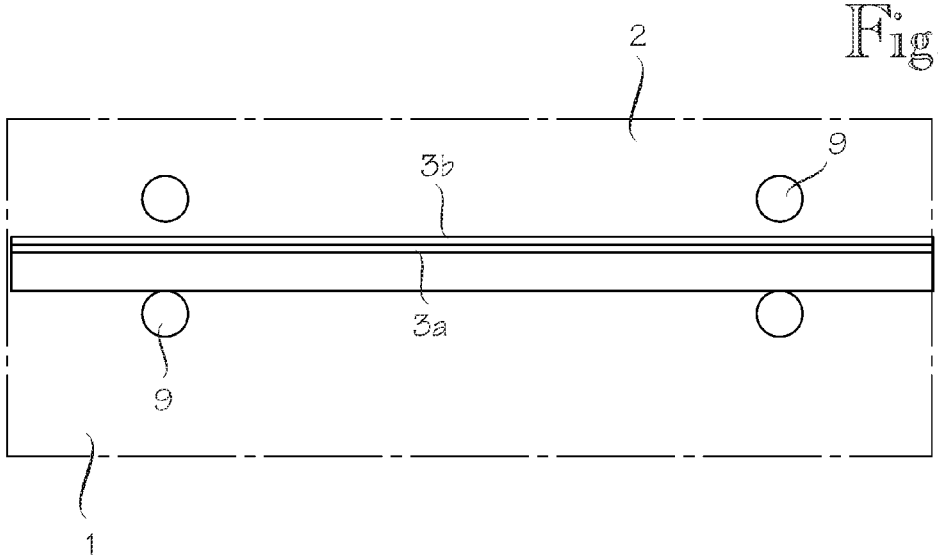
FIG. 5 shows a principled top view of the embodiment according to FIG. 4.

The invention is not in any way restricted to local dowels shown in FIGS. 1 to 3 but may also be applied in connection with continuous dowels. FIGS. 4 and 5 show an example of applying the invention in connection with a continuous dowel 4. In FIGS. 4 and 5, the same reference numerals are used at corresponding points as in the example of FIGS. 1 to 3.

In the embodiment according to FIGS. 4 and 5, the continuous dowel 4 is formed of concrete by utilizing a plate part 3, whereby the dowel 4 is formed of concrete and plate parts 3*a*, 3*b*. An additional reinforcement formed by clenching pins 9 is arranged, in accordance with the invention, to adhere to the concrete above and below the dowel 4 by means of widenings forming the clench point. The invention may also be applied to an expansion joint reinforcement having a continuous steel dowel.

The plate parts 3*a* and 3*b* and the additional reinforcement formed by the clenching pins 9 are fitted in place in the mould before casting, whereby after the casting a joint is formed between the concrete slabs 1, 2 in the structure, the joint having, thanks to the dowel 4, the same expansion properties in the horizontal direction as those described in connection with FIGS. 1 to 3.

The number of clenching pins 9 in the embodiment of FIGS. 4 and 5 is not restricted to that shown in these figures but may vary freely according to the need. The shapes of the clench points and the materials of the clenching pins may vary, as described in connection with the example of FIGS. 1 to 3.

The above embodiment examples are not, by any means, intended to restrict the invention but different implementations are also feasible. The invention may be varied completely freely within the scope of the claims. For instance, the structure of the expansion joint reinforcement or its details may naturally also deviate from the examples shown in the figures.

The invention claimed is:

1. An expansion joint system of a concrete slab arrangement, comprising:

an expansion joint reinforcement configured to be arranged between a first and a second concrete slab, the expansion joint reinforcement having:

a plate part configured to be arranged between the first and the second concrete slab, and at least one local dowel, the at least one local dowel being formed of a dowel plate and a casing part for preventing the dowel plate from adhering to concrete of the second concrete slab, the at least one local dowel being arranged to transfer loads perpendicular to a slab plane, wherein:

the dowel plate of the at least one local dowel is attached to the plate part, the casing part of the at least one local dowel is attached to the plate part, the casing part being configured to be arranged in concrete of the second concrete slab, the dowel plate of the at least one local dowel has a first part configured to be arranged in concrete of the first concrete slab for adhering to concrete of the first concrete slab, the dowel plate of the at least one local dowel has a second part located inside the casing part of the at least one local dowel for preventing the second part from adhering to concrete of the second concrete slab, and the expansion joint reinforcement includes an additional reinforcement having at least one clenching pin and is configured to be arranged in the vicinity of the at least one local dowel in the concrete of the first concrete slab or the concrete of the second concrete slab, the additional reinforcement being arranged to adhere to the concrete (i) above the at least one local dowel by means of an upper widening of the at least one clenching pin forming a first clench point and (ii) below the at least one local dowel by means of a lower widening of the at least one clenching pin forming a second clench point.

2. The expansion joint system of a concrete slab arrangement according to claim 1, wherein the additional reinforcement comprises a plurality of clenching pins.

3. The expansion joint system of a concrete slab arrangement according to claim 1, wherein the at least one clenching pin is configured to be in a substantially vertical position relative to the upper and lower surfaces of the concrete slabs.

4. The expansion joint system of a concrete slab arrangement according to claim 1, wherein the at least one clenching pin is manufactured of steel parts.

5. The expansion joint system of a concrete slab arrangement according to claim 4, wherein the at least one clenching pin is manufactured of ribbed bars.

6. The expansion joint system of a concrete slab arrangement according to claim 2, wherein at least one of the plurality of clenching pins is configured to be in a substantially vertical position relative to the upper and lower surfaces of the concrete slabs.

7. The expansion joint system of a concrete slab arrangement according to claim 2, wherein at least one of the plurality of clenching pins is clenching pins are manufactured of steel parts.

8. The expansion joint system of a concrete slab arrangement according to claim 3, wherein the at least one clenching pin is manufactured of steel parts.

9. The expansion joint system of a concrete slab arrangement according to claim 6, wherein the at least one of the plurality of clenching pins is manufactured of steel parts.

10. The expansion joint system of a concrete slab arrangement according to claim 7, wherein the at least one of the plurality of clenching pins is manufactured of ribbed bars.

11. The expansion joint system of a concrete slab arrangement according to claim 8, wherein the at least one clenching pin is manufactured of ribbed bars.

12. The expansion joint system of a concrete slab arrangement according to claim 9, wherein the at least one of the plurality of clenching pins is manufactured of ribbed bars.

13. An expansion joint system of a concrete slab arrangement, comprising:

an expansion joint reinforcement configured to be arranged between a first and a second concrete slab, the expansion joint reinforcement having:

a plate part configured to be arranged between the first and the second concrete slab, and a plurality of local dowels, each of the plurality of local dowels being formed of a dowel plate and a casing part for preventing the dowel plate from adhering to concrete of the second concrete slab, the plurality of local dowels being arranged to transfer loads perpendicular to a slab plane;

a first reinforcement configured to be arranged in the concrete of the first concrete slab at a first upper edge of the joint between the first concrete slab and the second concrete slab;

a second reinforcement configured to be arranged in the concrete of the second concrete slab at a second upper edge of the joint between the first concrete slab and the second concrete slab;

a plurality of first horizontal reinforcement parts fastened to the first reinforcement and configured to be arranged in concrete of the first concrete slab; and a plurality of second horizontal reinforcement parts fastened to the second reinforcement and configured to be arranged in concrete of the second concrete slab, wherein:

each dowel plate of the plurality of local dowels being attached to the plate part;

each casing part of the plurality of local dowels being attached to the plate part, the casing part being configured to be arranged in concrete of the second concrete slab;

each dowel plate of the plurality of local dowels has a first part configured to be arranged in concrete of the first concrete slab for adhering to concrete of the first concrete slab;

each dowel plate of the plurality of local dowels has a second part located inside a casing part of the plurality of local dowels for preventing the second part from adhering to concrete of the second concrete slab; and the expansion joint reinforcement system includes an additional reinforcement having:

a plurality of first clenching pins fastened to the first horizontal reinforcement parts and configured to be arranged in the vicinity of at least one local dowel in concrete of the first concrete slab and in a substantially vertical position relative to the upper and lower surfaces of the first concrete slab, each of the plurality of first clenching pins including a first lower widening arranged to adhere to concrete of the first concrete slab below at least one local dowel and a first upper widening arranged to adhere to concrete of the first concrete slab above at least one local dowel, and a plurality of second clenching pins fastened to the second horizontal reinforcement parts and configured to be arranged in the vicinity of at least one local dowel in concrete of the second concrete slab and in a substantially vertical position relative to the upper and lower surfaces of the second concrete slab, each of the plurality of second clenching pins including a second lower widening arranged to adhere to concrete of the second concrete slab below at least one local dowel and a third upper widening arranged to adhere to concrete of the second concrete slab below at least one local dowel.

* * * * *